US008939009B2

(12) United States Patent
Seidel et al.

(10) Patent No.: US 8,939,009 B2
(45) Date of Patent: Jan. 27, 2015

(54) METHOD FOR CALIBRATING TWO INTERACTING WORKING ROLLERS IN A ROLLING STAND

(75) Inventors: Jürgen Seidel, Kreuztal (DE); Olaf Norman Jepsen, Siegen (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 874 days.

(21) Appl. No.: 13/141,034

(22) PCT Filed: Dec. 17, 2009

(86) PCT No.: PCT/EP2009/009078

§ 371 (c)(1),
(2), (4) Date: Jun. 20, 2011

(87) PCT Pub. No.: WO2010/069575

PCT Pub. Date: Jun. 24, 2010

(65) Prior Publication Data

US 2011/0247391 A1 Oct. 13, 2011

(30) Foreign Application Priority Data

Dec. 18, 2008 (DE) ..... 10 2008 063 514
Jun. 27, 2009 (DE) ..... 10 2009 030 792

(51) Int. Cl.
*B21B 39/16* (2006.01)
*B21B 38/10* (2006.01)
(Continued)

(52) U.S. Cl.
CPC ..... *B21B 38/105* (2013.01); *B21B 13/142* (2013.01); *B21B 31/18* (2013.01); *B21B 37/58* (2013.01); *B21B 37/64* (2013.01); *B21B 2269/14* (2013.01)
USPC ..... 73/1.79

(58) Field of Classification Search
USPC ..... 73/1.79
See application file for complete search history.

(56) References Cited

U.S. PATENT DOCUMENTS 4,881,396 A 11/1989 Seidel et al.
5,714,692 A 2/1998 Rohde
(Continued)

FOREIGN PATENT DOCUMENTS

DE 69710817 T2 11/2002
EP 0876857 A2 11/1998
(Continued)

*Primary Examiner* — Hezron E Williams
*Assistant Examiner* — Mark A Shabman
(74) *Attorney, Agent, or Firm* — Lucas & Mercanti, LLP; Klaus P. Stoffel

(57) ABSTRACT

The invention relates to a method for calibrating a rolling stand (3), wherein in order to determine the relative pivot position of the roller set for setting a symmetrical roll gap and/or for determining the extension of the rolling stand (3) before the actual rolling process, the roller set is pressed against each other under a radial preset force and the resulting deformation of the rolling stand is preferably measured on the piston-cylinder unit (6, 7). The pivot position of the roller set and/or the frame module (M) determined based thereon are mathematically used during the subsequent rolling of a rolling stock between the working rollers (1, 2) for adjusting the roller set. In order to attain a higher accuracy during rolling, the invention provides for the working rollers (1, 2) to be axially adjustable relative to each other starting from a zero position that is not axially displaced, wherein the determination of the pivot position for setting a symmetrical roll gap and/or the determination of the frame module (M) are carried out in a relative displacement position of the working rollers (1, 2) that is not equal to the zero position (calibration position), wherein the determined pivot position and/or the value for the frame module (M) are stored and mathematically used for further calculating the pivot position and/or the adjustment of the roller set during rolling of the rolling stock.

20 Claims, 4 Drawing Sheets

Figure 1:
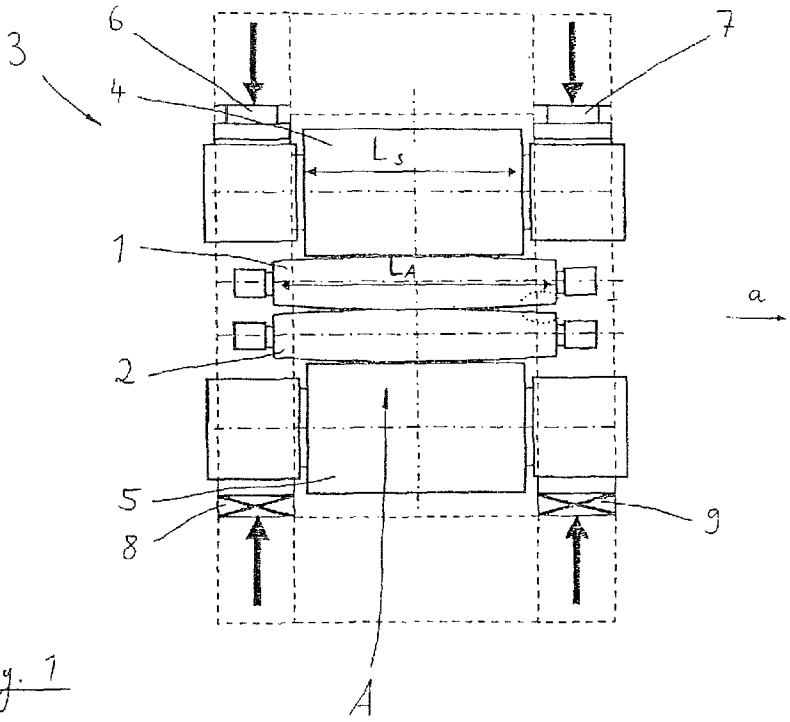

(51) Int. Cl.

| | |
|---|---|
| *B21B 13/14* | (2006.01) |
| *B21B 31/18* | (2006.01) |
| *B21B 37/58* | (2006.01) |
| *B21B 37/64* | (2006.01) |

(56) References Cited

U.S. PATENT DOCUMENTS

| | | | | |
|---|---|---|---|---|
| 5,875,663 | A | 3/1999 | Tateno et al. | |
| 5,943,896 | A | 8/1999 | Rosenthal et al. | |
| 6,920,774 | B1 * | 7/2005 | Bergman et al. | 72/160 |
| 8,505,611 | B2 * | 8/2013 | Otsuka | 164/428 |
| 2011/0247391 | A1 * | 10/2011 | Seidel et al. | 73/1.79 |
| 2011/0289996 | A1 * | 12/2011 | Seidel et al. | 72/241.2 |

FOREIGN PATENT DOCUMENTS

| | | | |
|---|---|---|---|
| EP | 0985461 | A1 | 3/2000 |
| EP | 0763391 | B1 | 7/2000 |
| JP | S49110565 | | 10/1974 |
| JP | 60030508 | A | 2/1985 |
| JP | 60030509 | | 2/1985 |
| JP | 62137116 | A | 6/1987 |
| JP | H01262008 | | 10/1989 |
| RU | 2194585 | C2 | 12/2002 |
| RU | 2258571 | C2 | 8/2005 |

* cited by examiner

METHOD FOR CALIBRATING TWO INTERACTING WORKING ROLLERS IN A ROLLING STAND

The present application is a 371 of International application PCT/EP2009/009078 filed Dec. 17, 2009, which claims priority of DE 10 2008 063 514.6, filed Dec. 18, 2008, and DE 10 2009 030 792.3, filed Jun. 27, 2009, the priority of these applications is hereby claimed and these applications are incorporated herein by reference.

BACKGROUND OF THE INVENTION

The invention relates to a method for calibrating a roll stand in which for determining the relative pivoted position of the roll set for the adjustment of a symmetrical roll gap and/or for determining the expansion of the roll stand prior to the actual rolling procedure, the roll set is pressed together by a radial force and the resulting deformation of the roll stand is preferably measured on the piston-cylinder unit, wherein the thereby determined pivoted position of the roll set and/or the stand thereby determined modulus (M) during the later rolling of a rolling stock between the work rolls is computationally utilized by the employment of the roll set.

Roll stands are well known in which interacting work rolls are supported by at least two back-up rolls in order to roll, for example, a steel strip. Reference is being made as an example to EP 0 763 391 B1.

For achieving a high quality when rolling a strip in a roll stand, it is required that after an exchange of the rolls of the roll stand a calibration is carried out.

If axial displacement systems are provided for the work rolls (for example, so-called CVC-system), the work rolls are during the calibration in a basic position (axial displacement is zero). During calibration, the work rolls are pressed directly on each other and the expansion curve is recorded, the strand modulus is determined, and the roll gap is adjusted to be parallel or symmetrical. This is taking place prior to the rolling process. During subsequent rolling, the conditions during calibration are simulated with a computer program and converted to the rolling conditions (strip width), and to be able to precisely adjust the strip thickness.

In the process, the following significant observations have been made: The strip width is in most cases significantly narrower than the contact width between the two work rolls. This means that there are different contact conditions during calibrating, on one hand, and during rolling on the other hand. This, in turn, leads to different stand expansions in the two cases mentioned above. Depending on the type of roll used (particularly when CVC-rolls are used), the stand modulus varies in dependence on the relative axial displacement between the work rolls. Moreover, during the axial displacement, the geometric conditions change in the roll gap as well as between the work and back-up rolls. This is especially true when no symmetrical rolls, but only rolls with asymmetrical profiles are used (for example, with CVC-grinding or a similar shape). The work rolls of roll stands with displacement are usually longer by twice the displacement distance than the length of the back-up rolls, or in conventional roll stands without axial displacement, they correspond to the length of the work rolls.

SUMMARY OF THE INVENTION

Therefore, it is the object of the invention to further develop the method of the above-described type in such a way that it becomes in a simple manner possible to take into consideration the effect of the different expansions of the stand during calibration and during rolling. The purpose of this is to achieve a greater accuracy during rolling. In particular, a calibration should be carried out in the axially displaced state of the work rolls (or also of the intermediate rolls in the case of a six-high stand) in order to obtain an accurate stand modulus and a reliable pivoting value of the rolls.

The object is met by the invention in that, starting from a not axially displaced zero position, the work rolls are axially displaceable relative to each other, wherein the determination of the pivoted position for adjusting a symmetrical roll gap and/or the determination of the stand modulus take place in a relative displacement position of the work rolls which is different from the zero position (calibration position), wherein the determined pivoted position and/or the value for the stand modulus are stored and utilized by computation for the further calculation of the pivoted position and/or adjustment of the roll set during rolling of the rolling stock.

Starting preferably from the stored pivoted position and/or the stored value for the stand modulus, a recomputation from the recalibrating position to the respectively current displaced position takes place.

Accordingly, the pivoted position for adjusting a symmetrical roll gap and/or the stand modulus in a relative axial position of the work rolls (preferably with maximum positive displacement position) is carried out at least once, and this position is stored and utilized as reference value for the further re-computation to other displacement positions.

A very preferred further development provides that the determination of the pivoted position for the adjustment of a symmetrical roll gap and/or the determination of the value of the stand modulus is carried out at least twice, namely, in a first relative axial position of the work rolls and in a second relative axial position of the work rolls, wherein the first relative axial position is different from the second relative axial position, and wherein the at least two determined pivoted positions and/or the values for the stand modulus are stored and utilized for the further computation of the pivoted position and/or the adjustment of the roll set during rolling of the rolling stock.

In accordance with a preferred feature, more than two pivoted positions and/or stand moduli are determined in the case of more than two different relative axial positions of the work rolls. For example, three to six pivoted positions and/or stand moduli can be determined with three to six different axial positions of the work rolls. In this connection, one of the pivoted positions and/or one of the stand moduli in the case of a maximum intended relative axial displacement of the work rolls can be determined.

The at least two determined pivoted positions and/or stand moduli at different relative axial positions of the work rolls can be placed in a functional relationship and made the basis of the further computation. Alternatively and for simplicity's sake, however, it is also possible to provide that from the at least two determined pivoted positions and/or stand moduli with different relative axial positions of the work rolls is formed an average value that is used for the further computation.

The work rolls can essentially have any outer surface, for example, a cylindrical outer contour. Also possible in the same manner is a spherical or concave outer contour of the work rolls. However, it is provided in accordance with a preferred feature that an asymmetrical work roll contour is present, for example, a combined spherical and concave outer contour (CVC-rolls) or generally an outer contour which can be described with a polynom, particularly with a polynom of at least the third order or with a trigonometric function.

When measuring the deformation of the stand, the force acting in the stand can be determined by means of at least one load cell. Alternatively, the force acting in a piston/cylinder unit for the radial adjustment of the work rolls can be determined the force. In this connection, it is also possible to determine the force determined by the load cell and the force acting in the piston/cylinder unit for each stand side.

In accordance with a further development, it is provided that the calibration takes place when a bending force acts on the work roll. In this respect, in a further development, it is also possible to provide that the calibration takes place with at least two different bending forces placed on the work roll.

In accordance with a further development, it can be provided that the roll stand is a six-high stand with work rolls, intermediate rolls and back-up rolls, wherein the above-described calibration procedure for the work-roll set is also carried out for each intermediate rolls. In this case, it can be provided that in work and intermediate rolls which are displaceable relative to each other, the calibration procedure takes place in the axially displaced state of the work and intermediate rolls and the pivoted positions are recorded for adjusting a symmetrical roll gap and/or the stand modulus.

Accordingly, in order to be able to adjust the roll gap more precisely and more stably, the invention provides, among others, that the calibration procedure takes place not only in the middle position (without relative axial displacement of the work rolls), but also in the displaced state of the work rolls. The contact length between the work rolls is shorter in the case of a given axial displacement of the rolls and may correspond to the length of the back-up rolls and, thus, the strip width. Depending on the grinded shape of the work rolls, a maximum positive or negative work roll displacement position can be adjusted. As reference displacement position during calibration can be used any chosen displacement position, for example, the maximum displacement position.

BRIEF DESCRIPTION OF THE INVENTION

Figure 2:
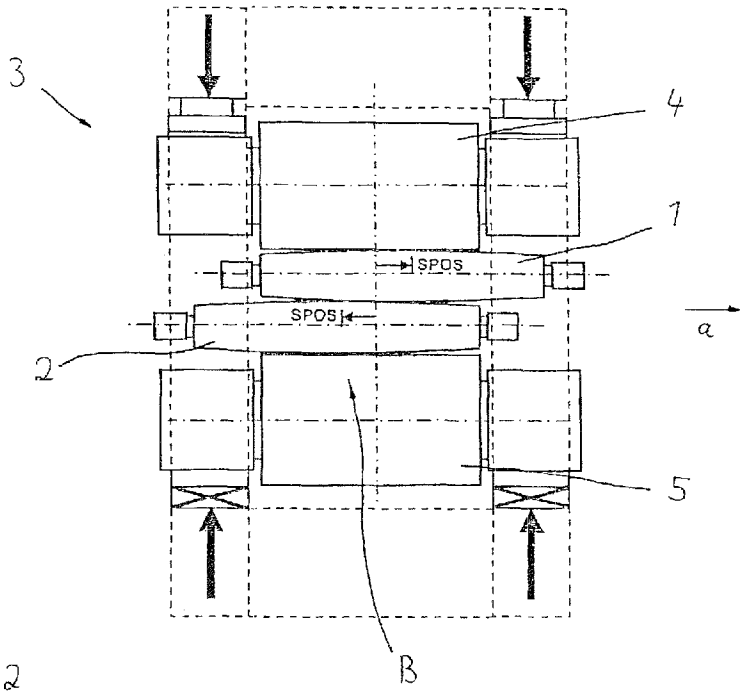
Figure 3:
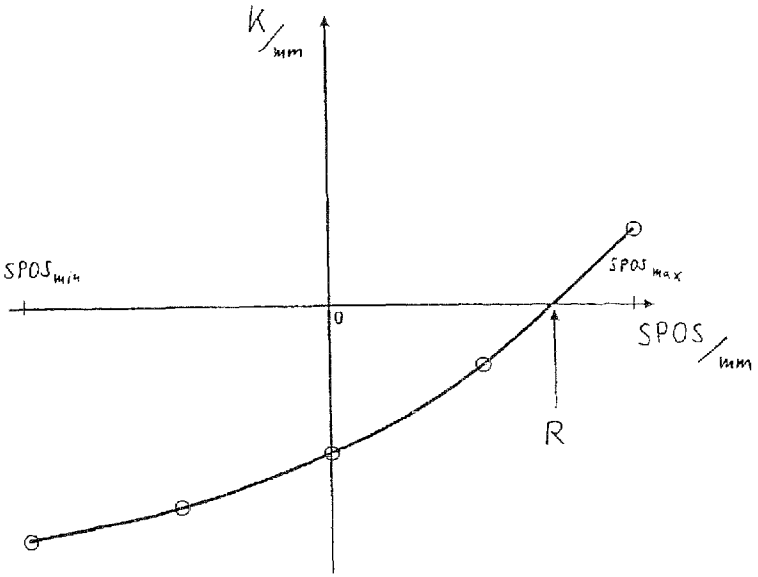
Figure 4:
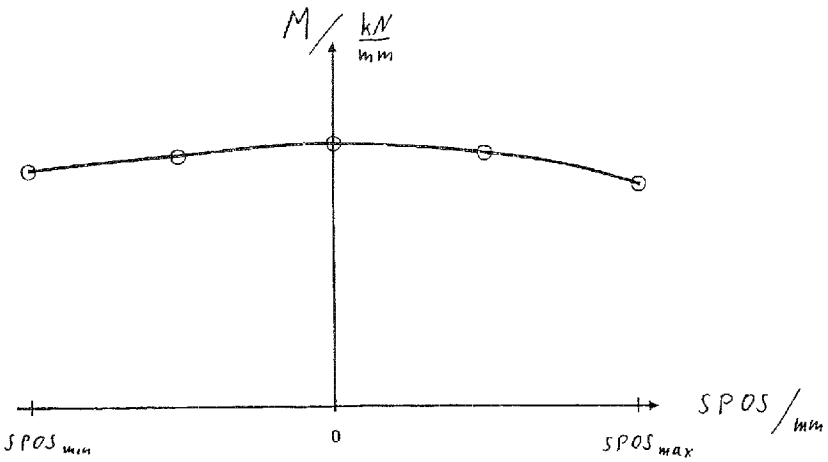

FIG. 1 schematically shows a roll stand with two work rolls and two back-up rolls in a first position during calibration, seen in the rolling direction, FIG. 2 shows the roll stand according to FIG. 1 in a second position of the work rolls during calibration, FIG. 3 shows the actuation of an adjustment position correction value concerning the work roll displacement, and FIG. 4 shows the pattern of a stand modulus above the work roll displacement.

DETAILED DESCIPTION OF THE INVENTION

FIG. 1 illustrates a roll stand 3 which has two interacting work rolls 1 and 2. The work rolls 1 and 2 are supported by back-up rolls 4 and 5. In the present case, the work rolls 1, 2 are not constructed cylindrically but they have a spherical roll surface which is illustrated in the Figure by exaggeration.

The work rolls 1, 2 have a length $L_A$ which is greater than the length $L_S$ of the back-up rolls 4, 5.

During operation it is provided that the work rolls 1, 2 are adjusted relative to each other in an axial direction A. In FIG. 1, axial position A is shown in which no relative axial displacement of the work rolls 1, 2 is present (basic position).

Further illustrated are piston cylinder units 6, 7 by means of which the rolls and particularly the work rolls 1, 2 are radially adjustable on top of each other in order to be able to adjust a defined roll gap for rolling a rolling stock which is not illustrated. The force acting between the work rolls 1, 2 and, thus, also in the stand 3, can be determined by load cells 8, 9.

Prior to rolling a rolling stock, the stand 3 as well as the work rolls 1, 2 are calibrated. For this purpose, the expansion of the roll stand 3 under a radial force acting between the work rolls 1, 2 is determined, i.e., the so-called stand modulus M is determined. Moreover, the roll gap is adjusted symmetrically (free of wedge) relative to the stand middle.

During the calibration, which is illustrated in a first calibration method step in FIG. 1, the two work rolls 1, 2 are directly pressed onto each other. In that case, the work rolls are located in the basic position A, i.e., the relative axial displacement is zero (SPOS=0). The contact length of the work rolls 1, 2 is in comparison to the gap between the work and the back-up rolls slightly greater than twice the displacement stroke.

When the work rolls, 1, 2 are pressed together, the resulting deformation of the roll stand 3 and the contact pressure force and reaction force are determined. The stand modulus M determined in this manner is then utilized for computing the rolling of the rolling stock in the position or adjustment of the work rolls. This is sufficiently well known as such.

It is now very advantageous that the determination of the pivoting position for the adjustment of the symmetrical roll gap or the determination of the stand modulus M takes place at least twice, namely initially in a first relative axial position A of the work rolls 1, 2 as shown in FIG. 1.

Subsequently, the pivoted position for adjusting the symmetrical roll gap and/or the stand modulus M is determined at least one more time, namely in a second relative axial position B of the work rolls 1, 2 as illustrated in FIG. 2. As can be seen, the work rolls 1, 2 are in this case displaced in the axial direction a, i.e., each by a distance SPOS of several millimeters.

The two determined values for the pivoted position and/or the stand modulus M are stored and utilized for the further computation of the position of the work rolls 1,2 for rolling the rolling stock.

The stand moduli are different in the two relative axial positions A (FIG. 1) and B (FIG. 2). From the geometric conditions it is possible with the aid of the two determined stand moduli M to also calculate the adjustment correction value K for rolling. The adjusted position correction values are also different in the two positions A and B.

In the present embodiment, this idea is further developed. In that case, not only two positions (A, B) for the relative axial positions of the work rolls are observed, but altogether five different positions. If the pattern of the adjusting position K and the stand modulus M is plotted over the work roll displacement SPOS, the functional patterns in FIGS. 3 and 4 are reached, i.e., more precisely, the points marked with circles through which the entered functional pattern can then be placed. The left and right end points on the abscissa correspond to the maximum or minimum displacement path $SPOS_{max}$ and $SPOS_{min}$ of the work rolls 1, 2. This functional pattern can then be made the basis for the computation of the effective middle adjustment of the work rolls. Entered in FIG. 3 is also a reference position R during calibration from the functional patterns according to FIG. 3 or 4.

It is also provided in accordance with the embodiment that the calibration procedure is carried out in several (here: five) different displacement positions and the expansion curve is stored as a function of the displacement position and is made the basis of the further computation. As a result of the calibration procedure with the addition of several expansion curves are provide more accurate correction values K of the adjusting position for the thickness control as well as for the stand modulus M as a function of the work roll displacement. These values are stored. In this way, not only the computational values are used but also the accuracy is increased by the use of the measurement values at different displacement positions.

In accordance with a simplified embodiment of the invention, it is also possible that a middle value of the pivoting position for adjusting a symmetrical roll gap and/or the determined stand moduli or correction values are formed and used as the basis for the further computation.

Using a computational model, the geometric changes and modifications of the load distributions in the roll gap and between work and back-up rolls as well as the attendant expansion changes of calibration state are simulated and compared to the measured values. Accordingly, the computational model is adapted which increases the placement accuracy. In accordance with another step, a re-computation is carried out during the rolling process from the calibration state to the respectively actual displacement position and strip width. The thickness regulation takes into consideration these effects and, thus, adjusts a more accurate thickness.

The work rolls preferably used in the present method do not have cylindrical outer contours; rather, they are preferably so-called CVC-rolls or also such rolls that, can be described by a trigonometrical function. Accordingly, they are asymmetrically profiled work rolls. However, it is basically possible to use the method for any type of roll, i.e., especially in cylindrical work rolls, in conventionally positively or negatively tilted work rolls, with so-called with "tapered" rolls (see in this connection EP 0 819 481), in so-called CVP-tapered rolls (see in this connection EP 0 876 857) or generally in work rolls which can be described generally by a radius function with a polynomial of the n-ter order ($R(x)=a_0+a_1x+a_2x^2+\ldots+a_nx^n$ with R: Radius, x: Longitudinal coordinate of the roll body, a: polynomial coefficients).

Accordingly, for receiving the expansion curve or in the calibration process measured load cell forces or the cylinder forces are utilized as reference force. Alternatively, it is also possible to form the average value of load cell force and cylinder force are formed for each side and used during the calibration process.

Optionally, during the calibration process the work roll bending force of the balancing force is raised to, for example, the maximum bending force. In order to more precisely understand the effect of the work roll bending to the expansion behavior, or respectively, to determine the zero point more exactly, it is provided as further alternative, or supplement, to perform the calibration process for two different bending force levels. The results are used for correcting or automatically adapting the stand expansion moduli and the influence of the work roll bending during actual border conditions (for example diameter, roll grinds) are more accurately described.

In the proposed calibration, the calibration process is carried out in such a way that the calibration (also) takes place in such a way that the contact length of the work rolls relative to each other is reduced, particularly in such a way that the contact length of the work rolls corresponds approximately to the length of the back-up rolls. Accordingly, for example, the calibration takes place in such a way that the work rolls are only driven onto an axial displacement value (preferably on the maximal positive displacement value). This displacement position during the calibration process is stored as a reference position. With a computer model, geometric changes and changes of the load distribution in the roll gap and between the work and back-up rolls as well as the attendant expansion changes are computed for the respectively actual displacement position during the rolling process. The thickness regulation compensates these changes and adjusts the precise thickness.

The procedure has herein been described as in connection with an example of a four-high stand. Analogously, the method is also provided for carrying it out with a six-high stand. In the calibration of these stands with longer intermediate rolls, the intermediate rolls are, for example, moved to the maximum displacement position or the calibration is carried out at different displacement positions. Analogously, pivoted positions and correction values and stand moduli are stored in dependence on the intermediate roll displacement positions. If work and intermediate rolls are constructed so as to be displaceable, both effects are superimposed.

REFERENCE NUMERALS

1 Work roll
2 Work roll
3 Roll stand
4 Back-up roll
5 Back-up roll
6 Piston-cylinder-unit
7 Piston-cylinder-unit
8 Load cell
9 Load cell
A First relative axial position
B Second relative axial position
$L_A$ Work roll length
$L_S$ Back-up roll length
SPOS axial displacement of the work roll
$SPOS_{max}$ Maximal displacement distance
$SPOS_{min}$ Minimal displacement distance
K Correction position
R Reference position during calibrating
M Stand modulus

The invention claimed is:

1. A method of calibrating a roll stand, comprising the steps of determining the relative pivoted position of a roll set for adjustment of a symmetrical roll gap or for determining expansion of the roll stand before an actual rolling process of a rolling procedure, by pressing the roll set together with addition of a radial force, measuring a resulting deformation of the roll stand at a piston/cylinder unit, utilizing a resulting pivoted position of the roll set or a resulting stand modulus (M) for computation during later rolling of rolling stock between work rolls with adjustment of the roll set, wherein the work rolls, starting from a zero position which is not axially moved, are moveable axially relative to each other, the determination of the pivoted position for the adjustment of a symmetrical roll gap or the determination of the stand modulus (M) takes place in a relative displaced position of the work rolls which is different from the zero position (calibrating position), storing the determined pivoted position or the value for the stand modulus (M), and using the determined pivot position or the value of the stand modulus by computation for further calculation of the pivoting position or adjustment of the roll set during rolling of the rolling stock.

2. The method according to claim 1, further including re-computing the calibration position into a respectively actual displacement position starting from the stored pivoted position or the stored value of the stand modulus (M).

3. The method according to claim 1, including determining the determination of the pivoted position for the adjustment of a symmetrical roll gap or determining the stand modulus (M) at least twice, namely in a first relative axial position of the work rolls and in a second relative axial position of the work rolls wherein the first relative axial position differs from the second relative axial position, and storing the at least two determined pivoted positions or values for the stand modulus (M) and using the stored positions or values by computation for further computation of the pivoted position or the adjustment of the work rolls during rolling of the rolling stock.

4. The method according to claim 3, including determining more than two pivoted positions and/or stand moduli (M) in more than two relative axial positions of the work rolls.

5. The method according to claim 4, including determining three to six pivoted positions and/or stand moduli (M) at six relative axial positions of the work rolls.

6. The method according to claim 3, including determining one of the pivoted positions or one of the stand moduli (M) in an intended maximum relative axial displacement of the work rolls.

7. The method according to claim 3, including placing the at least two determined pivoted positions and/or stand moduli (M) in different relative axial positions of the work rolls into a functional relationship and using the positions in the further computation.

8. The method according to claim 3, including forming an average value from the minimum two determined pivoted positions and/or stand moduli (M) at different relative axial positions of the work rolls and using the average value in the further computation.

9. The method according to claim 1, wherein the work rolls have a cylindrical outer contour.

10. The method according to claim 1, wherein the work rolls have a spherical or concave outer contour.

11. The method according to claim 1, wherein the work rolls have a combined spherical and concave outer contour (CVC-rolls).

12. The method according to claim 1, wherein the work rolls have an outer contour which can be described by a polynomial.

13. The method according to claim 12, wherein the work rolls have an outer contour which can be described by a polynom of at least the third order, or by a trigonometric function.

14. The method according to claim 1, including determining a force acting in the roll stand by at least load cell when measuring deformation of the roll stand.

15. The method according to claim 14, including determining force acting in at least one piston/cylinder unit for radially adjusting the work rolls when measuring the deformation of the roll stand, and averaging the force determined by the load cell and the force acting in the piston/cylinder unit on a first side and on a second side.

16. The method according to claim 1, including determining force acting in at least one piston/cylinder unit for radially adjusting the work rolls when measuring the deformation of the roll stand.

17. The method according to claim 1, including carrying out the calibration when applying a bending force to the work roll.

18. The method according to claim 17, wherein the calibration takes place by applying at least two different bending forces to the work roll.

19. The method according to claim 1, wherein the roll stand is a six-high stand with work rolls, intermediate rolls, and back-up rolls, the method including carrying out the calibration process for the work rolls and for the intermediate rolls.

20. The method according to claim 19, wherein when work and intermediate rolls axially displaceable relative to each other are present, the calibration process takes place in an axially displaced state of the work and intermediate rolls, and the pivoted position for adjusting a symmetrical roll gap and/or the stand modulus (M) is stored.

* * * * *